US011325269B2

(12) United States Patent
Lazenby

(10) Patent No.: US 11,325,269 B2
(45) Date of Patent: May 10, 2022

(54) CUTTING TOOL

(71) Applicant: LEATHERMAN TOOL GROUP, INC., Portland, OR (US)

(72) Inventor: Adam Lazenby, Lake Oswego, OR (US)

(73) Assignee: LEATHERMAN TOOL GROUP, INC., Portland, OR (US)

( * ) Notice: Subject to any disclaimer, the term of this patent is extended or adjusted under 35 U.S.C. 154(b) by 209 days.

(21) Appl. No.: 16/773,274

(22) Filed: Jan. 27, 2020

(65) Prior Publication Data

US 2021/0229299 A1 Jul. 29, 2021

(51) Int. Cl.
*B26B 13/00* (2006.01)
*B26B 13/22* (2006.01)

(52) U.S. Cl.
CPC ..... *B26B 13/005* (2013.01); *B26B 13/22* (2013.01)

(58) Field of Classification Search
CPC ..... B26B 13/005; B26B 13/22; B26B 11/005; B26B 11/003; B26B 13/28; B26B 13/20; B26B 13/12; B26B 13/06; B26B 13/14; B26B 13/18; B26B 13/16
USPC ..... 30/261, 253, 245, 232, 271, 298, 341, 30/296.1, 13, 1; 81/427, 300, 342, 427.5; D8/51, 57
See application file for complete search history.

(56) References Cited

U.S. PATENT DOCUMENTS 4,507,864 A * 4/1985 Leibowitz ..... B26B 13/12 30/239
5,092,049 A * 3/1992 Grubbs ..... B26B 13/12 30/248
5,745,997 A * 5/1998 Berg ..... B25F 1/04 30/155
5,829,329 A * 11/1998 Frazer ..... B25F 1/003 81/427.5
6,065,213 A * 5/2000 Rivera ..... B25F 1/003 30/155
6,578,221 B2 * 6/2003 Ping ..... B25F 1/003 7/128
7,204,022 B2 * 4/2007 Tsuda ..... B26B 13/005 30/194
8,707,563 B2 * 4/2014 Avery ..... B26B 11/001 30/152
9,656,399 B2 * 5/2017 Brainard ..... B26B 27/00
2003/0126748 A1 * 7/2003 Cachot ..... B26B 13/005 30/255
2005/0193498 A1 * 9/2005 Klecker ..... B25F 1/04 7/158
2016/0221199 A1 * 8/2016 Wong ..... B26B 13/12
2019/0001512 A1 * 1/2019 Wong ..... A01G 3/0255

* cited by examiner

*Primary Examiner* — Ghassem Alie
(74) *Attorney, Agent, or Firm* — Alston & Bird LLP

(57) ABSTRACT

A cutting tool is provided which may include a first blade and a second blade, where the first blade is coupled to the second blade at a first pivot point, where the first blade defines a cam follower and pivots relative to the second blade about a first pivot axis through the first pivot point; and a lever pivotably coupled to the second blade at a second pivot point, where the lever defines a cam surface and pivots relative to the second blade about a second pivot axis through the second pivot point, where the second blade is driven toward the first blade in response to the lever being advanced toward the first pivot point and the cam follower translating along the cam surface.

18 Claims, 7 Drawing Sheets

CUTTING TOOL

TECHNOLOGICAL FIELD

Embodiments of the present disclosure relate generally to a multipurpose cutting tool and, more particularly, to a collapsible or folding pair of scissors or shears configured with a cam-and-follower closure mechanism.

BACKGROUND

Cutting tools such as shears or scissors are common instruments for cutting a variety of materials ranging from paper and textiles to plastics and metals. The sizes and shapes of cutting tools may be configured based upon the material they are intended to cut. For example, small scissors may be used for various materials associated with sewing, such as threads or fabrics, or they may be used for cutting paper. Larger scissors or shears may be configured to cut through thicker or tougher materials, such as cardboard or fiber glass, for example.

Multipurpose tools are widely popular for their utility in a substantial number of different applications. As its name suggests, a multipurpose tool includes a number of tools carried by a common frame. A multipurpose tool may include different combinations of tools depending upon its intended application. For example, multipurpose tools that are designed for a more universal or generic application can include pliers, a wire cutter, a bit driver, one or more knife blades, a saw blade, a bottle opener or the like. Other multipurpose tools are designed to service more specific applications or niche markets and correspondingly include tools that are useful for the intended application. For example, multipurpose tools may be specifically designed for automobile repairs, hunting, fishing or other outdoor applications, gardening and the like.

One reason for the popularity of multipurpose tools is the capability provided by a multipurpose tool to provide a wide range of functionality with a single tool, thereby reducing the need to carry a number of different tools to perform those same functions. For example, a single multipurpose tool may be carried instead of a pair of pliers, one or more screwdrivers, a knife and a bottle opener. As such, the burden upon a user is reduced since the user need only carry a single multipurpose tool. However, the implementation of scissors in multi-purpose tools has generally been limited to light-duty scissors with limited functionality.

BRIEF SUMMARY OF THE INVENTION

Embodiments of the present invention may include a cutting tool which may be embodied in a multipurpose tool or as a cutting tool that folds into a handle. According to an example embodiment, the cutting tool may include: a first blade and a second blade, where the first blade is pivotably coupled to the second blade at a first pivot point, where the first blade pivots relative to the second blade about a first pivot axis through the first pivot point; and a lever pivotably coupled to the second blade at a second pivot point, where the lever pivots relative to the second blade about a second pivot axis through the second pivot point. One of the first blade and the lever defines a cam surface, and the other of the first blade and the lever defines a follower. In response to the lever being driven in a first direction, the follower moves relative to the cam surface, closing the first blade with respect to the second blade to form a cutting nip.

According to some embodiments, the cutting tool may include a spring element, where in response to the first blade closing with respect to the second blade, the first blade presses against a bias of the spring element. The spring element provides a bias force to the lever in a second direction opposite the first direction. According to some embodiments, the second blade is coupled to the lever with a fastener defining an axis along the first pivot axis, where the first blade defines an arcuate slot, and where in response to the first blade closing with respect to the second blade, the fastener translates within the arcuate slot.

The cutting tool of some embodiments may define a deployed position and a stowed, folded position. The cutting tool may include a spring element, where the spring element biases the first blade away from the second blade in response to the cutting tool being disposed in the deployed position, and does not drive the first blade away from the second blade in response to the cutting tool being disposed in the stowed, folded position. The second blade may include a recess, where the recess engages a tab in response to the cutting tool being disposed in the deployed position, where the second blade becomes fixed in the deployed position in response to the tab engaging the recess. The spring element may be aligned with and engaged with a driving element of the first blade in response to the cutting tool being disposed in the deployed position. The spring element may be driven out of alignment with the first blade in response to the cutting tool being disposed in the stowed, folded position.

The first pivot axis may be defined through a handle of a multipurpose tool, where the first blade and the second blade are configured to pivot about the first pivot axis between a deployed position in which the cutting tool is operable for cutting and a stowed, folded position within the handle of the multipurpose tool in which the cutting tool is not operable for cutting.

Embodiments provided herein may include a multipurpose tool including a cutting tool translatable between a folded, stowed position relative to the multipurpose tool and a deployed position relative to the multipurpose tool. The cutting tool includes: a first blade; a second blade, where the second blade pivots relative to the multipurpose tool about a first axis between the folded, stowed position and the deployed position, where the first blade pivots relative to the multipurpose tool about the first axis between the folded, stowed position and the deployed position; and a lever pivotably coupled to the second blade and pivotable relative to the second blade about a second axis, different from the first axis, where in response to the cutting tool being disposed in the deployed position, driving the lever toward the multipurpose tool causes the first blade to pivot about the first axis toward the second blade.

According to some embodiments, in response to the cutting tool being disposed in the deployed position, a cutting nip is formed between the first blade and the second blade, and where the lever closes the cutting nip in response to being driven toward the multipurpose tool. Embodiments may include a spring element. In response to the cutting tool being disposed in the deployed position, the spring element biases the first blade away from the second blade. In response to the cutting tool being disposed in the stowed, folded position, the spring element does not bias the first blade away from the second blade. The spring element may be aligned with the first blade and a driving element of the first blade engages the spring element in response to the cutting tool being disposed in the deployed position. A portion of the first blade may drive the spring element from alignment with the first blade in response to the cutting tool being moved to the stowed, folded position.

The multipurpose tool of some embodiments includes a cam surface defined by the lever, where the first blade includes a follower. In response to the cutting tool being disposed in the deployed position and lever being advanced toward the multipurpose tool, the cam surface of the lever drives the follower to close the first blade relative to the second blade at the cutting nip.

Embodiments provided herein may include a cutting tool having: a first blade and a second blade, where the first blade is coupled to the second blade at a first pivot point, where the first blade defines a cam follower and pivots relative to the second blade about a first pivot axis through the first pivot point; and a lever pivotably coupled to the second blade at a second pivot point, where the lever defines a cam surface and pivots relative to the second blade about a second pivot axis through the second pivot point, where the second blade is driven toward the first blade in response to the lever being advanced toward the first pivot point and the cam follower translating along the cam surface. The first blade may define a slot where the lever is pivotably coupled to the second blade by a fastener that passes through the slot in the first blade. Embodiments may include a spring element, where the spring element engages a driving element of the first blade and biases the first blade away from the second blade. Embodiments may include a handle, where the second blade is held fixed relative to the handle, and where the first blade and lever move relative to the second blade to perform a cutting operation.

BRIEF DESCRIPTION OF THE SEVERAL VIEWS OF THE DRAWINGS

Figure 1:
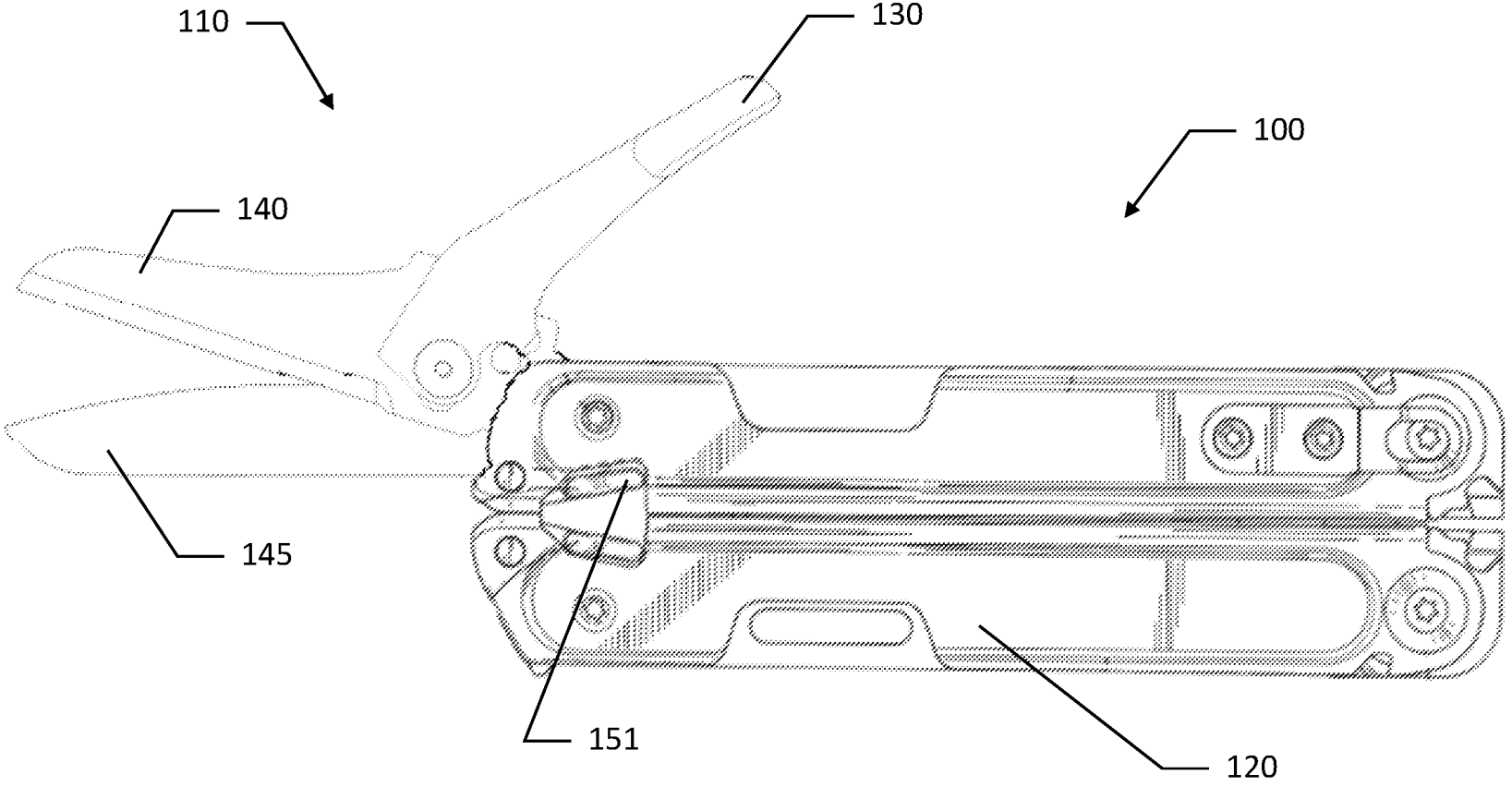
Figure 2:
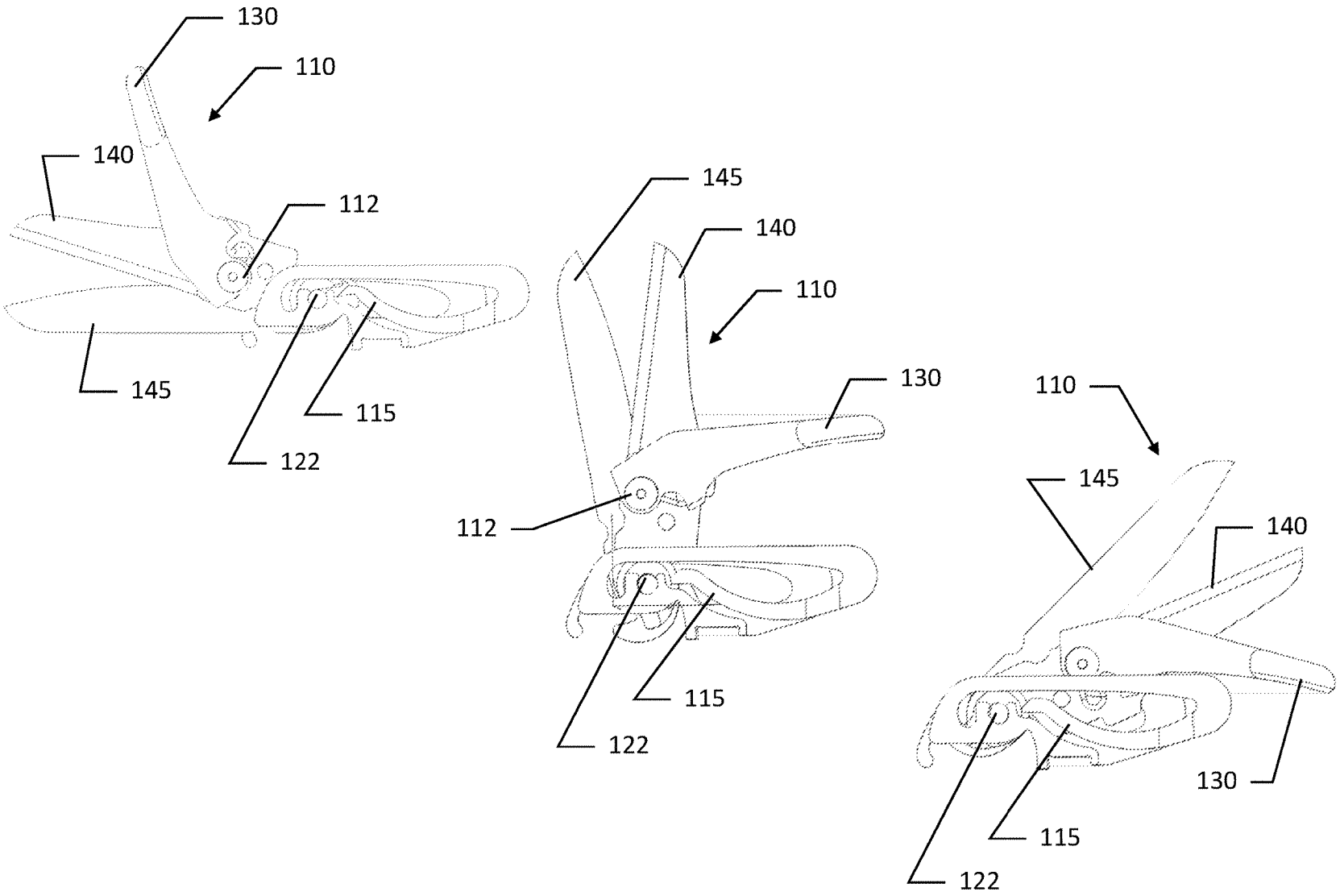
Figure 3:
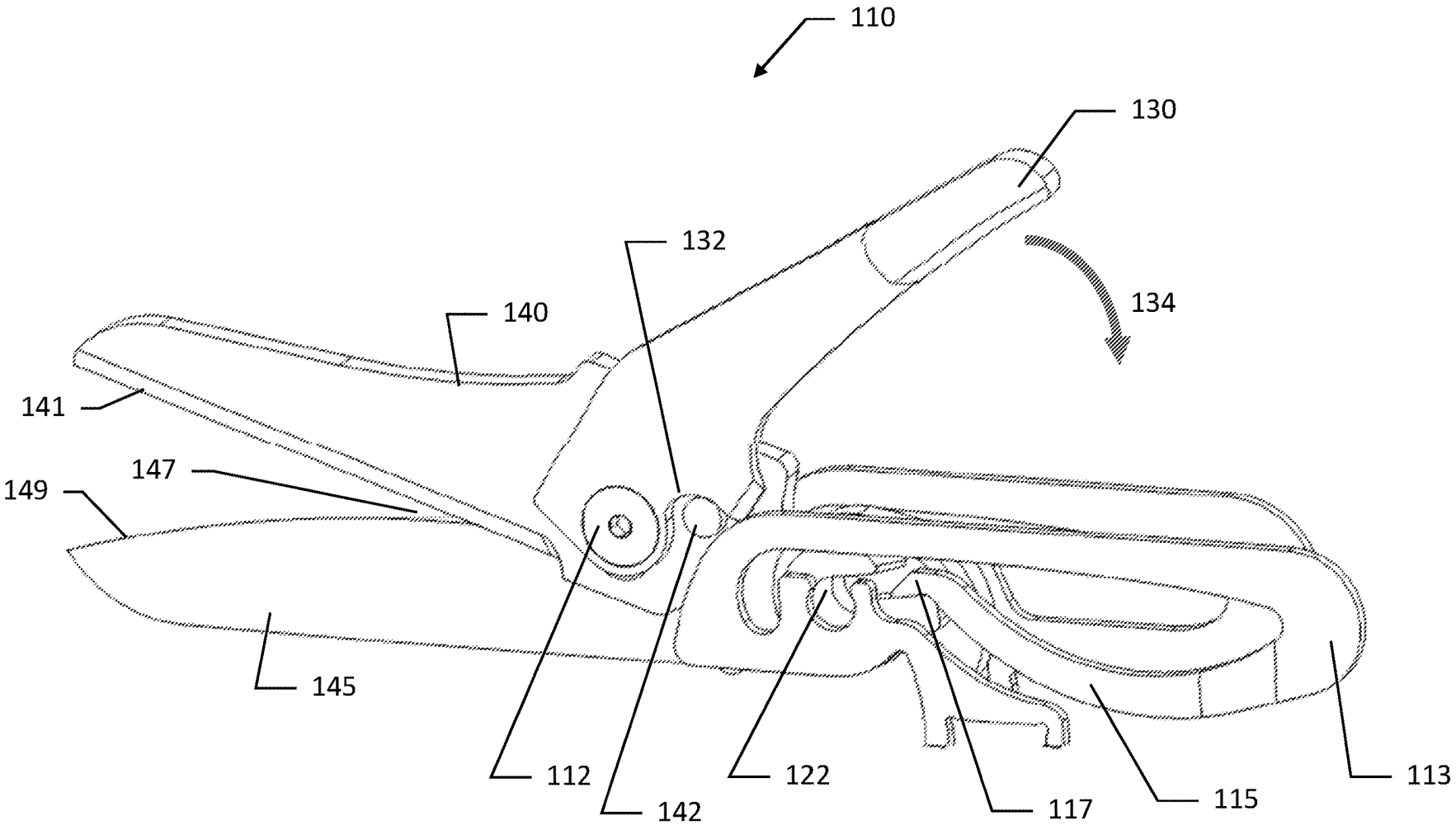
Figure 4:
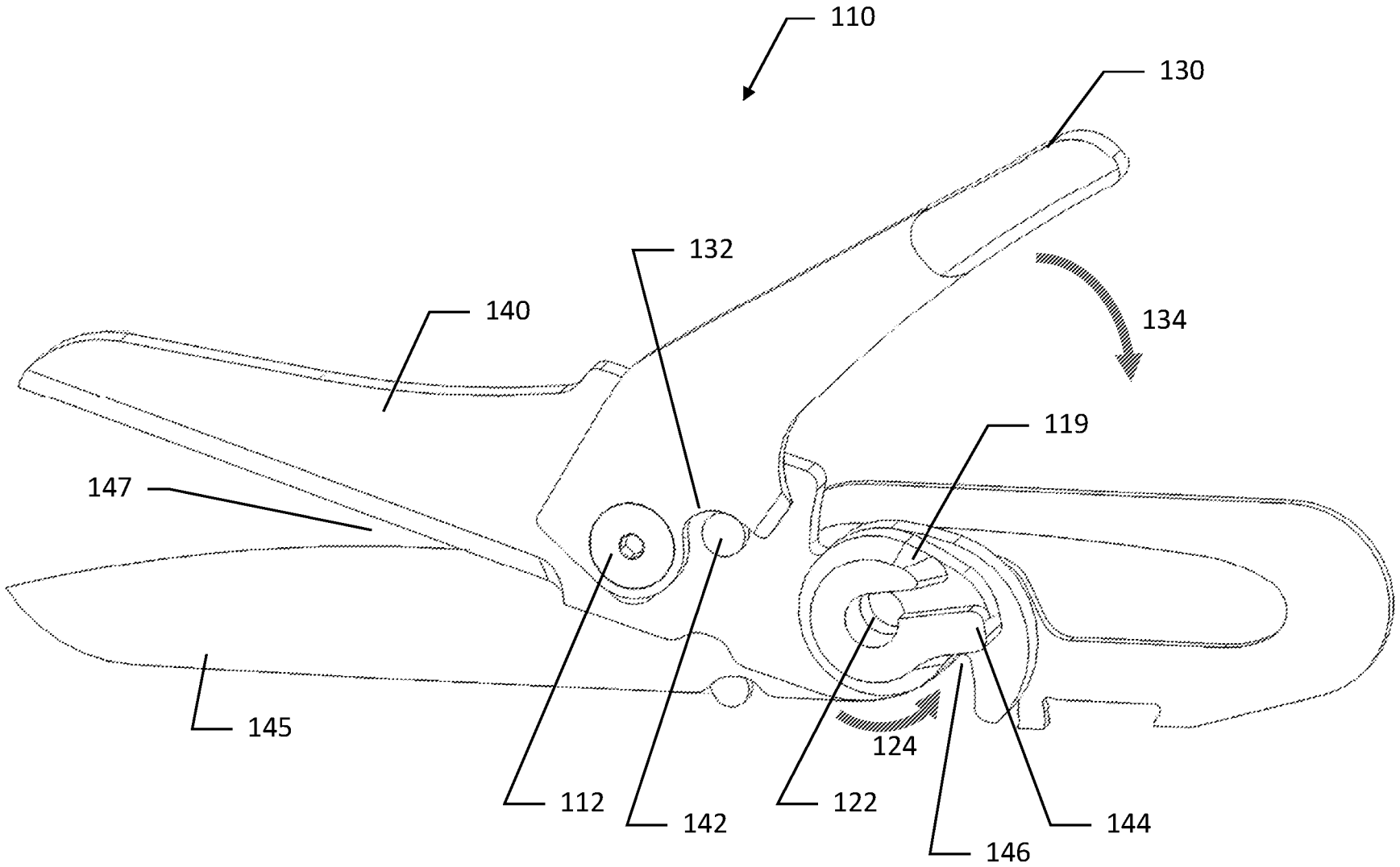
Figure 5:
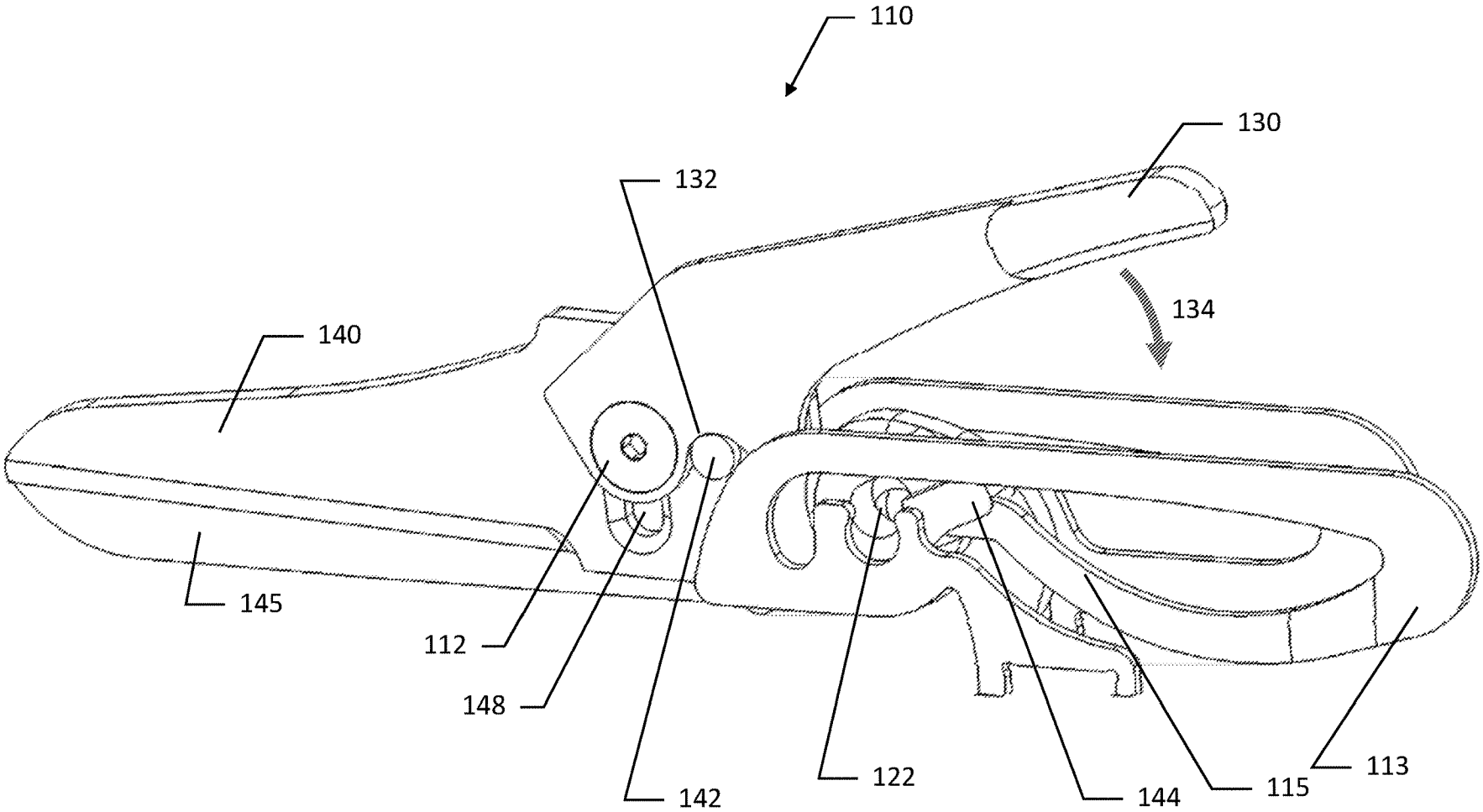
Figure 6:
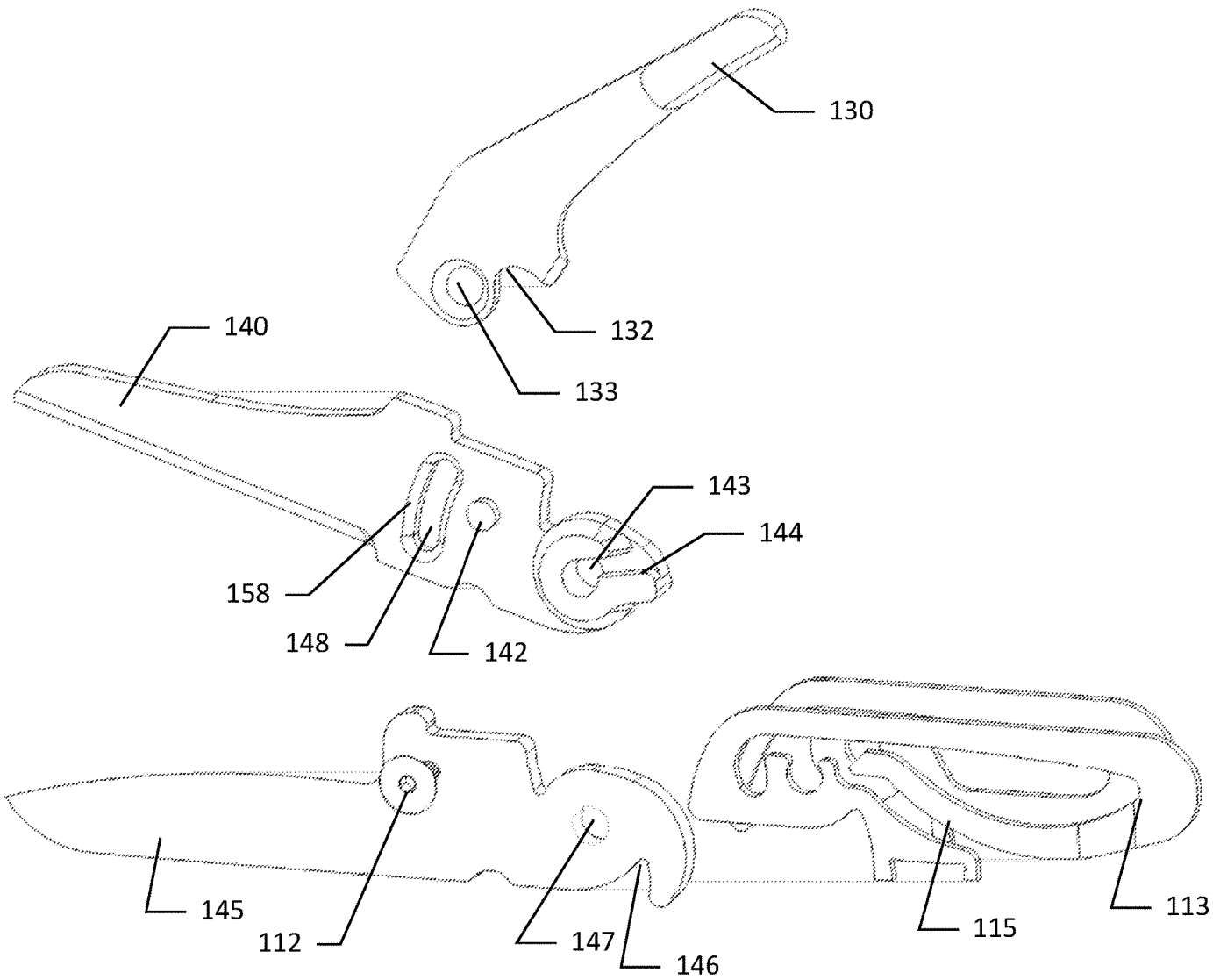
Figure 7:
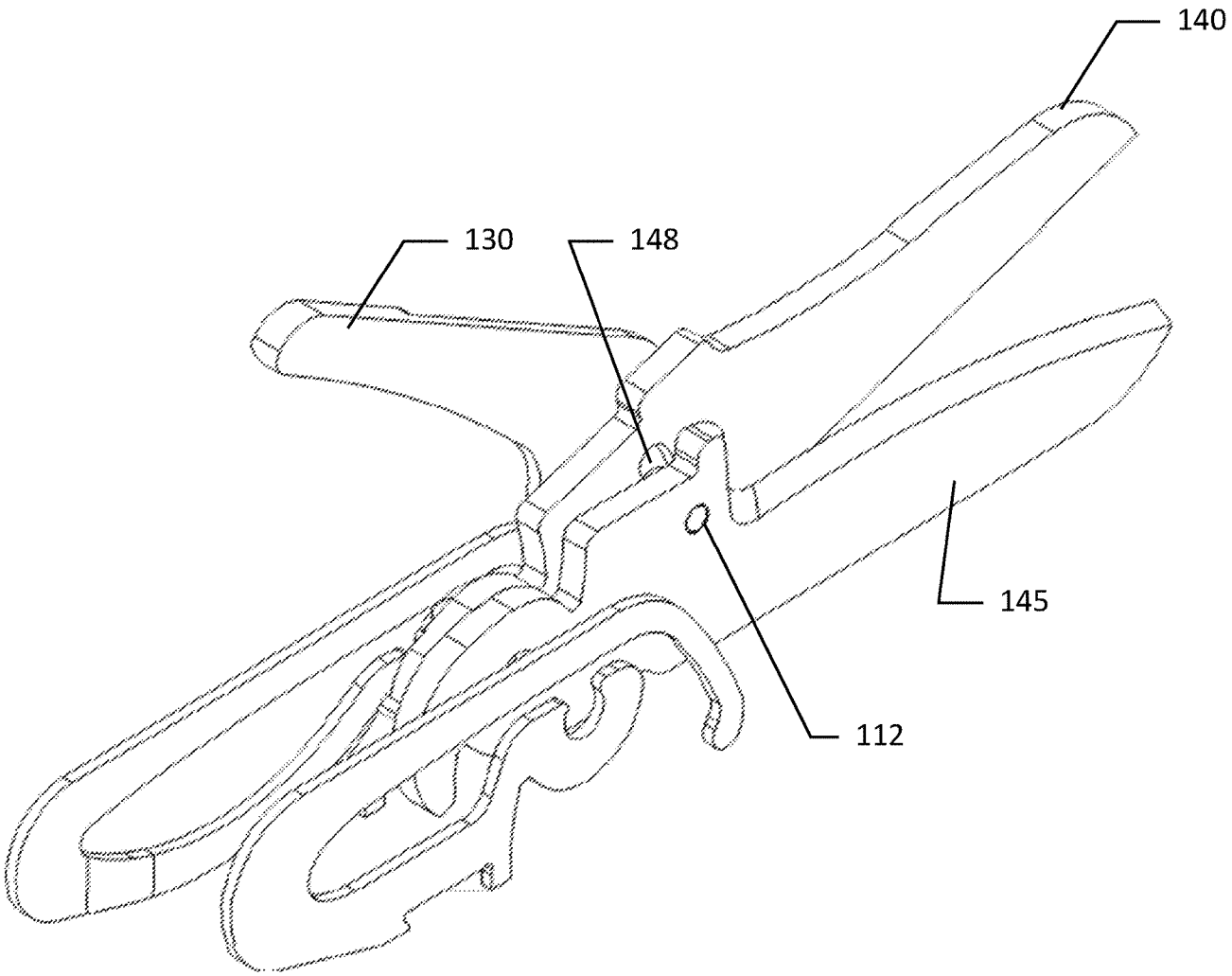

Having thus described the invention in general terms, reference will now be made to the accompanying drawings, which are not necessarily drawn to scale, and wherein:

FIG. 1 illustrates a multipurpose tool having a pair of deployable scissors according to an example embodiment of the present disclosure;

FIG. 2 illustrates a sequence of movements of a pair of deployable scissors from a deployed, unfolded position to a folded, stowed position according to an example embodiment of the present disclosure;

FIG. 3 illustrates a pair of deployable/foldable scissors in a deployed position according to an example embodiment of the present disclosure;

FIG. 4 illustrates the pair of deployable/foldable scissors of FIG. 3 as the blades are closed at a cutting nip in a partially closed position according to an example embodiment of the present disclosure;

FIG. 5 illustrates the pair of deployable/foldable scissors of FIG. 3 as the blades are closed at a cutting nip in a closed position according to an example embodiment of the present disclosure;

FIG. 6 illustrates an exploded view of a pair of deployable/foldable scissors according to an example embodiment of the present disclosure; and FIG. 7 illustrates another view of a pair of deployable/foldable scissors according to an example embodiment of the present disclosure.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, a multipurpose tool 100 is illustrated with a pair of scissors 110 shown in the deployed position relative to a body 120 of the tool 100. As shown, in the deployed position, a user may grasp the body 120 of the tool 100 between a palm of a hand and the fingers, while a thumb is used to actuate the scissors 110 using lever 130 depressed by the thumb of the hand. Such a configuration provides a stable grip of the tool 100 while providing sufficient leverage for a thumb to apply pressure to the lever 130. Example embodiments described herein maximize that leverage to translate the blades 140, 145 of the scissors 110 from an open position (as shown) and a closed position, shown and described further below.

Example embodiments of scissors as described herein for use with a multipurpose tool may need to be folded into the body 120 of the tool 100. FIG. 2 illustrates a mechanism by which embodiments of the present disclosure may be folded to a stowed position from a deployed position. FIG. 2 illustrates a folding operation of folding the scissors 110 from a deployed position in the top left figure, toward a stowed position. The body of the tool is omitted from the illustrations of FIG. 2 for clarity, while a the spring element 115 that resides in the body of the tool is illustrated as will be detailed further below.

As shown, the first blade 140 and the second blade 145 rotate about pivot axis 122 of the tool body 120 toward the stowed position. The lever 130 rotates about a fastener 112 defining a pivot point, where the fastener 112 passes through a slot (shown in detail below) in the first blade 140 and is secured to the second blade 145. As illustrated, the first blade 140, second blade 145, and lever 130 each fold into the body of the tool in a stowed position.

FIG. 3 illustrates an example embodiment of a pair of scissors 110 according to an example embodiment of the present disclosure in the deployed position. As shown, the first blade 140 and second blade 145 pivot relative to one another about a pivot axis 122 to open and close a cutting nip 147, defined where a cutting edge 141 of the first blade 140 intersects a cutting edge 149 of the second blade 145. In order to move the first blade 140 relative to the second blade 145, example embodiments described herein employ a cam surface and follower arrangement to improve leverage and to maintain a compact and foldable form factor for the scissors 110. As shown, the first blade 140 includes a follower 142 formed in the blade or attached thereto, while the lever 130 defines a cam surface 132. While the first blade 140 to include the follower 142 and the lever 130 defining the cam surface 132, embodiments may reverse this arrangement with the first blade 140 including a cam surface and the lever 130 defining a follower. In the deployed position of FIG. 3, with the lever 130 rotating toward the body of the tool along arrow 134, the cam surface 132 engages the follower 142. The cam surface 132 serves to drive the follower 142 of the first blade 140 toward the second blade 145, thereby closing the blades at the cutting nip 147 to execute a cutting operation.

FIG. 4 illustrates the embodiment of FIG. 3, with spring element 115 removed for clarity. As shown, the first blade 140 includes a driving element 144 that rotates with the first blade 140 about the pivot point 122. As the lever 130 is driven along arrow 134, resulting in counter-clockwise rotation of the first blade 140 about pivot point 122 when viewed as shown in FIGS. 3 and 4, the driving element 144 also rotates counter-clockwise about the pivot point 122 along arrow 124. Referring back to FIG. 3, as driving element 144 is driven in the counter-clockwise direction of arrow 124, the driving element 144 engages and presses against point 117 of the spring element 115. As spring element 115 is deflected by driving element 144, the spring element produces a counter-acting biasing force exerted by point 117 against the driving element 144 to bias the first blade 140 into an open position. This enables a user to apply pressure to lever 130 using their thumb, but to allow the spring bias of spring element 115 to open the scissors upon completion of the cutting operation.

The biasing of the first blade 140 and the second blade 145 into an open position is useful during operation of the scissors. However, biasing the blades apart is not beneficial when the blades are stowed within the body of the tool in the folded position. As such, embodiments described herein only provide biasing of the blades away from one another when the scissors 110 are in the deployed position relative to the body of the tool 100. To accomplish this, the spring element 115 is held fixed relative to the axis of rotation 122 of the first and second blades, such that when the first blade 140, second blade 145, and the lever 130 are rotated relative to the body 120 of the tool as shown in FIG. 2, the driving element 144 moves away from the spring element 115 and point 117, such that the first blade 140 may close relative to the second blade 145 without any spring force acting to separate the first blade from the second blade.

The spring element 115 is part of a spring body 113, as shown in FIG. 3. However, as the spring body 113 does not align with the first blade 140 and driving element 144, the spring element 115 is biased inwardly along the axis of rotation 122 to align point 117 with driving element 144 when the cutting tool 110 is disposed in the deployed position shown in FIGS. 3 and 4. However, when the cutting tool is moved to the stowed, folded position, the spring element 115 must be moved to avoid the folding first blade 140. In order to accomplish this, as shown in FIG. 4, the first blade may include a chamfered surface 119 configured to engage the spring element 115 and drive the spring element toward the spring body 113 to move the spring element 115 from being aligned with the first blade 140, thereby avoiding an interference between the first blade 140 and the spring element 115 when the first blade is in the folded, stowed configuration. While a chamfered surface is illustrated, various configurations could be used to drive the spring element toward the spring body 113, such as a radiused surface, a ramp, or the like. Referring back to the folding operation illustrated in FIG. 2, as shown, when the first blade 140 folds from the deployed position to the folded position, the spring element 115 is driven out of alignment with the first blade 140 in a direction orthogonal to the figure toward a viewer of the figure.

In the open, deployed position of the scissors 110 relative to the multipurpose tool 100, the second blade 145 is held fixed relative to the tool body 120 to enable the first blade 140 to be moved relative to the second blade to execute a cutting operation. To hold the second blade 145 in the open position relative to the tool body 120, the tool body may be equipped with a locking tab (shown as 151 in FIG. 1) that engages a recess 146 of the second blade 145, as shown in FIG. 4. Such a locking tab may be spring-biased into engagement with the recess 146, and may engage the recess until the locking tab is driven against the bias by a user to disengage the recess 146, and to allow the second blade 145 to rotate about pivot axis 122 toward the stowed, folded position.

Referring back to FIG. 3, a force applied to the lever 130 to drive the lever along arrow 134 toward the body of the tool 120 causes cam surface 132 to engage and drive cam follower 142 toward the second blade 145. As the cam follower 142 is attached to the first blade 140, and as the fastener 112 fixes the lever 130 in a pivotal relationship with the second blade 145, the first blade 140 is driven toward the second blade 145 to close the cutting nip 147. FIG. 5 illustrates the first blade 140 in a closed position relative to the second blade 145, and more clearly illustrates the arcuate slot 148 in the first blade 140 through which the fastener 112 passes as the fastener is secured in a fixed position on the second blade 145. The cooperation between the slot 148 and the fastener 112 enables the cam surface 132 to engage and drive the follower 142 to pivot the first blade 140 relative to the second blade 145 about pivot axis 122 in order to close the blades together at the cutting nip.

FIG. 6 illustrates an exploded view of the components of the scissors 110 of example embodiments described herein. As shown, the lever 130 includes a cam surface and a through-hole 133 through which the fastener 112 is received. The first blade 140 includes a slot 148 through which the fastener 112 passes, along with follower 142 to engage cam surface 132 of the lever 130. The first blade 140 also includes the driving element 144 that acts against spring element 115 when closing the scissors in the deployed position to cause the scissors to open, where the first blade 145 is driven away from the second blade 140 when force on the lever 130 is removed. The first blade 140 also includes through hole 143 about which the first blade pivots relative to the second blade 145 and relative to the body 120 of the multipurpose tool 100. The second blade 145 includes the attached fastener 112 and through hole 147 about which the second blade rotates relative to the body 120 of the tool 100. Further, the second blade 145 includes recess 146 which is engaged by a tab (not shown) of the tool body 120 to secure the second blade 145 in the deployed position. The tab may be disengaged from the recess 146 in order to enable the second blade to be moved from the deployed position to the folded position relative to the tool body 120.

The fastener 112 of some embodiments may be a flat-headed fastener having a countersink chamfer configured to engage a countersink of through hole 133. The chamfer of the fastener 112 and the countersink of hole 33 may be configured such that they cooperate to press the first blade 140 toward the second blade 145 as the blades are closed relative to one another when the lever 130 is pressed. In this manner, as the lever 130 is pressed, the first blade may be driven toward the second blade to press the cutting edges (141 and 149 of FIG. 3) toward one another as the blades are closed relative to one another, thereby improving the cutting operation at the cutting nip between the cutting edges of the blades.

FIG. 7 illustrates another view of the scissors 110 shown without the multipurpose tool 100 of FIG. 1. As shown, the first blade 140 is captured between the lever 130 and the second blade 145 by fastener 112 secured through the slot 148 of the first blade 140.

Many modifications and other embodiments of the inventions set forth herein will come to mind to one skilled in the art to which these inventions pertain having the benefit of the teachings presented in the foregoing descriptions and the associated drawings. For example, while embodiments described herein generally refer to a cutting tool for use with a multipurpose tool, embodiments of the cutting tool described above may be incorporated into a tool that has no other significant function other than operating as a handle for the cutting tool into which the cutting tool may be folded, thereby providing a compact cutting tool. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cutting tool comprising:

a first blade and a second blade, wherein the first blade is pivotably coupled to the second blade at a first pivot point, wherein the first blade is configured to pivot relative to the second blade about a first pivot axis through the first pivot point; and a lever pivotably coupled to the second blade at a second pivot point, wherein the lever is configured to pivot relative to the second blade about a second pivot axis through the second pivot point, wherein one of the first blade and the lever defines a cam surface, wherein the one of the first blade and the lever not defining a cam surface defines a follower, wherein in response to the lever being driven in a first direction, the follower is configured to move relative the cam surface, closing the first blade with respect to the second blade to form a cutting nip, wherein the second blade is coupled to the lever with a fastener defining an axis along the first pivot axis, wherein the first blade defines an arcuate slot, and wherein in response to the first blade closing with respect to the second blade, the fastener is configured to translate within the arcuate slot.

2. The cutting tool of claim 1, further comprising a spring element, wherein in response to the first blade closing with respect to the second blade, the first blade is configured to press against a bias of the spring element.

3. The cutting tool of claim 2, wherein the spring is configured to provide a bias force to the lever in a second direction opposite the first direction.

4. The cutting tool of claim 1, wherein the cutting tool defines a deployed position and a stowed, folded position, the cutting tool further comprising a spring element, and wherein the spring element is configured to bias the first blade away from the second blade in response to the cutting tool being disposed in the deployed position, and configured to not drive the first blade away from the second blade in response to the cutting tool being disposed in the stowed, folded position.

5. The cutting tool of claim 4, wherein the second blade further comprises a recess, wherein the recess is configured to engage a tab in response to the cutting tool being disposed in the deployed position, and wherein the second blade is configured to become fixed in the deployed position in response to the tab engaging the recess.

6. The cutting tool of claim 4, wherein the spring element is aligned with and engaged with a driving element of the first blade in response to the cutting tool being in the deployed position.

7. The cutting tool of claim 6, wherein the spring element is driven out of alignment with the first blade in response to the cutting tool being disposed in the stowed, folded position.

8. The cutting tool of claim 1, wherein the first pivot axis is defined through a handle of a multipurpose tool, and wherein the first blade and the second blade are configured to pivot about the first pivot axis between a deployed position in which the cutting tool is operable for cutting and a stowed, folded position within the handle of the multipurpose tool in which the cutting tool is not operable for cutting.

9. A multipurpose tool comprising:

a cutting tool translatable between a folded, stowed position relative to the multipurpose tool and a deployed position relative to the multipurpose tool, the cutting tool comprising:

a first blade;

a second blade, wherein the second blade is configured to pivot relative to the multipurpose tool about a first axis between the folded, stowed position and the deployed position, and wherein the first blade is configured to pivot relative to the multipurpose tool about the first axis between the folded, stowed position and the deployed position; a lever pivotally coupled to the second blade and pivotable relative to the second blade about a second axis different from the first axis, wherein in response to the cutting tool being disposed in the deployed position, driving the lever toward the multipurpose tool causes the first blade to pivot about the first axis toward the second blade; and a spring element, wherein the spring element is configured to engage a driving element of the first blade and biases the first blade away from the second blade.

10. The multipurpose tool of claim 9, wherein in response to the cutting tool being disposed in the deployed position, a cutting nip is formed between the first blade and the second blade, and wherein the lever is configured to close the cutting nip in response to being driven toward the multipurpose tool.

11. The multipurpose tool of claim 9, further comprising a spring element, wherein:

in response to the cutting tool being disposed in the deployed position, the spring element is configured to bias the first blade away from the second blade, and in response to the cutting tool being disposed in the stowed, folded position, the spring element is configured to not bias the first blade away from the second blade.

12. The multipurpose tool of claim 11, wherein the spring element is aligned with the first blade and a driving element is configured to engage the spring element in response to the cutting tool being disposed in the deployed position.

13. The multipurpose tool of claim 12, wherein a portion of the first blade is configured to drive the spring element from alignment with the first blade in response to the cutting tool being moved to the stowed, folded position.

14. The multipurpose tool of claim 9, wherein the second blade comprises a recess and the multipurpose tool comprises a tab, and wherein in response to the second blade being advanced to the deployed position, the tab is configured to engage the recess to lock the second blade in the deployed position.

15. The multipurpose tool of claim 14, wherein the lever comprises a cam surface, wherein the first blade comprises a follower, and wherein responsive to the cutting tool being disposed in the deployed position and lever being advanced toward the multipurpose tool, the cam surface of the lever is configured to drive the follower to close the first blade relative to the second blade at the cutting nip.

16. A cutting tool comprising:

a first blade and a second blade, wherein the first blade is pivotably coupled to the second blade at a first pivot point, wherein the first blade defines a cam follower and is configured to pivot relative to the second blade about a first pivot axis through the first pivot point;

a lever pivotably coupled to the second blade at a second pivot point, wherein the lever defines a cam surface and is configured to pivot relative to the second blade about a second pivot axis through the second pivot point, wherein the second blade is configured to be driven toward the first blade in response to the lever being advanced toward the first pivot point and the cam follower translating along the cam surface; and a spring element, wherein the spring element is configured to engage a driving element of the first blade and biases the first blade away from the second blade.

17. The cutting tool of claim 16, wherein the first blade defines a slot, and wherein the lever is pivotably coupled to the second blade by a fastener that passes through the slot in the first blade.

18. The cutting tool of claim 16, further comprising a handle, wherein the second blade is held fixed relative to the handle, and wherein the first blade and lever are configured to move relative to the second blade to perform a cutting operation.

* * * * *